United States Patent [19]

Littleton

[11] Patent Number: 4,675,925

[45] Date of Patent: Jun. 30, 1987

[54] DEVICE FOR MANIPULATING BEDRIDDEN PATIENTS

[76] Inventor: Henrietta Littleton, 13102 King Cir., Cypress, Tex. 77429

[21] Appl. No.: 847,957

[22] Filed: Apr. 3, 1986

[51] Int. Cl.[4] ..... A61G 7/10

[52] U.S. Cl. ..... 5/61; 5/81 R; 5/484

[58] Field of Search ..... 5/61, 81 R, 82 R, 424, 5/508, 484, 485, 482, 460, 490, 501

[56] References Cited

U.S. PATENT DOCUMENTS

| | | | |
|---|---|---|---|
| 1,334,901 | 3/1920 | Higdon | 5/500 |
| 2,788,530 | 4/1957 | Ferguson | 5/82 R |
| 3,829,914 | 8/1974 | Treat | 5/495 |
| 4,445,242 | 5/1984 | Bowen | 5/485 |
| 4,536,903 | 8/1985 | Parker | 5/81 R |
| 4,572,174 | 2/1986 | Eilender et al. | 5/485 |
| 4,599,756 | 7/1986 | Koffler | 5/484 |

FOREIGN PATENT DOCUMENTS

| | | | |
|---|---|---|---|
| 1056586 | 3/1954 | France | 5/501 |

*Primary Examiner*—Alexander Grosz

*Attorney, Agent, or Firm*—Neal J. Mosely

[57] ABSTRACT

A deivce for manipulating bedridden patients in a hospital bed into various positions of rest comprises a flexible, pliant sheet of porous fabric with a removable absorbent pad and a pair of tie-straps extending outwardly from each side for removably securing the sheet to the bed in an extended position beneath the torso of the patient and a pair of handles extending from the side portions whereby an individual may move one side portion of the sheet into partially encircling relation to the torso of the patient for rolling the patient from a supine position into a comfortable position on one side. The tie-straps on either side are releasable from the lower bed railings of one side of the bed to be refastened on the top bed railings on the same side of the bed where the remaining tie-straps are still fastened to hold the sheet to the bed railings in the partially encircling position to insure uniform and comfortable engagement of the sheet and pad with the patient's torso. In one embodiment the pad is removably secured to the top surface of the sheet, and in another embodiment the pad is removably received between two layers of the sheet.

6 Claims, 6 Drawing Figures

DEVICE FOR MANIPULATING BEDRIDDEN PATIENTS

BACKGROUND OF THE INVENTION

1. Field of the Invention

This invention relates generallly to devices for invalid care, and more particularly to an improved device for manipulating bedridden patients in hospital beds.

2. Brief Description of the Prior Art

Invalid positioning devices are known in the art. There are several patents which disclose various devices used for manipulating bedridden patients.

Parker, U.S. Pat. No. 4,536,903 discloses a device for manipulating patients comprising, in the preferred embodiment, a single integral sheet of porous "breathable" fabric having a laterally extending portion which extends outwardly below the patient's arm pits to leave the arms and legs free of confinement when the device is being used. A pair of bands or straps parallel with the side edges allow a sheet of absorbant material to be held in place over the fabric sheet. Rigid tubular reinforcing members are enclosed in a hem along the side edges of the laterally extending portion and bails formed of flexible looped ropes are extended through the tubular members. The ends of the each bail is closed upon itself and provided with a handle, and a Velcro (a registered trademark for hook and loop type quick release fasteners) strap is attached to the handle. Alternatively, the bails are replaced with a pair of Velcro (a registered trademark for hook and loop type quick release fasteners) straps at the laterally extending sides.

Treat, U.S. Pat. No. 3,829,914 discloses a patient positioning device comprising a double-layered, elongated flexible laminated sheet having a friction-type top surface of woven material for frictionally supporting a patient, and a slippery bottom surface of plastic material slidable along the bed. Longitudinal end loop handles of fabric attached at each corner allow for the pulling of the patient along the bed and anchoring the laminated sheet to the bed. Longitudinal side strap handles of fabric spaced along each side of the sheet allow for transversely shifting and lifting the patient. The device is designed for use in shifting a patient longitudinally and transversely of a bed and for use as a soft stretcher in lifting and transporting a patient.

Laubsch, U.S. Pat. No. 3,284,816 discloses a suplemental bed sheet combination which allows for restoring a bedridden patient to a desired position from a slumped position when occupying a bed of the jointed and angularly adjustable type. The sheet comprises a piece of fabric stitched inwardly of the lateral side edges to form a pair of parallel longitudinally extending loops or tubes. A pair of wooden poles are inserted into the tubes and gripped by an attendant at each side of the bed to elevate the sheet to facillitate shifting the patient longitudinally on the bed.

Walters, U.S. Pat. No. 4,021,870 discloses a drawsheet comprising a base sheet of textile material, a panel of water penetration resistant material bonded to the base sheet and a water-absorbant pad removably attached to the panel whereby the water-absorbant pad can be removed and laundered. Walters does not teach or suggest a patient manipulating device.

Neilson, U.S. Pat. No. 3,849,813 discloses another bedding drawsheet not suitable for patient manipulation. The drawsheet has a central portion of substantially frictionless material attached at each lateral side edge to a panel of normal sheeting material. The drawsheet is placed atop the bed sheet and secured by tucking in the side panels. The central portion allows the patient to easily slide thereover.

The present invention is distinguished over the prior art in general, and these patents in particular by providing a drawsheet for manipulating bedridden patients having a removable absorbent pad and tie-straps extending from each side for removably securing the sheet to a hospital bed beneath the torso of the patient. The drawsheet has a pair of handles on each side whereby an individual may move one side of the sheet into partially encircling relation to the torso of the patient and may roll the patient from a supine position into a comfortable position on one side. The tie-straps on either side are releasable from the lower bed railings of one side of the bed to be refastened on the top bed railings on the side of the bed where the tie-straps remain fastened for holding the sheet to the bed railings in the partially encircling position.

SUMMARY OF THE INVENTION

It is therefore an object of the present invention to provide a device for manipulating bedridden patients which facilitates the turning of bedridden patients and maintaining them in a desired position to shift their weight from bedsores or tender body areas and reduce the possibility of fluid in the lungs resulting from improper turning of the patient.

It is another object of this invention to provide a device for manipulating bedridden patients which may be easily operated by a single person therby reducing the number of attendants and staff required to care for a patient.

Another object of this invention is to provide a device for manipulating bedridden patients which replaces the common drawsheet or pads to protect the bedding which often cause discomfort to the patient due to poor heat transfer of the materials used, and eliminates the need for periodic changing and laundering of soiled bed sheets.

Another object of this invention is to provide a device for manipulating bedridden patients which reduces the danger of wrist or back strain of attendants in the turning of bedridden patients.

A further object of this invention is to provide a device for manipulating bedridden patients which is simple in construction, economical to manufacture, attractive in appearance, and rugged and durable in use.

Other objects of the invention will become apparent from time to time throughout the specification and claims as hereinafter related.

The above noted objects and other objects of the invention are accomplished by a drawsheet for manipulating bedridden patients having a removable absorbent pad and tie-straps extending from each side for removably securing the sheet to a hospital bed beneath the torso of the patient. The drawsheet has a pair of handles on each side whereby an individual may move one side of the sheet into partially encircling relation to the torso of the patient and may roll the patient from a supine position into a comfortable position on one side. The tie-straps on either side are releasable from the lower bed railings of one side of the bed to be refastened on the top bed railings on the side of the bed where the tie-straps remain fastened for holding the sheet to the bed railings in the partially encircling position.

DESCRIPTION OF THE PREFERRED EMBODIMENT

Figure 1:
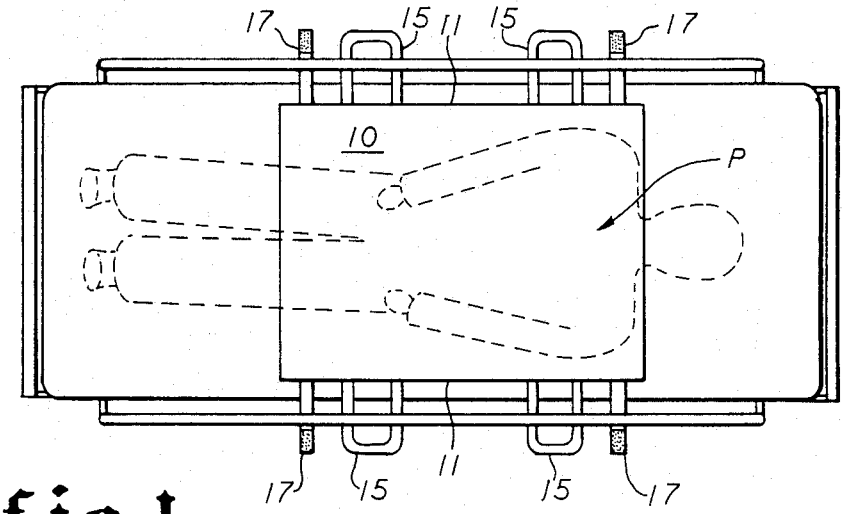
FIG. 1 is a top plan view of a hospital bed with a preferred embodiment of the device for manipulating bedridden patients arranged on the bed beneath a patient illustrated in dotted line.
Figure 2:
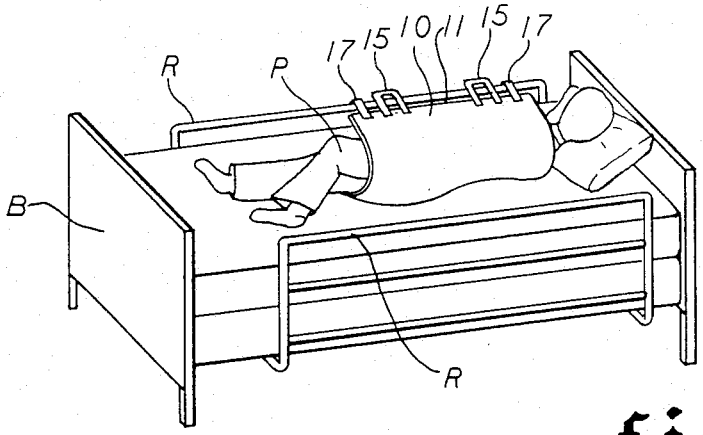
FIG. 2 is a perspective view showing the patient rolled over on his side and held in such position by the device of the invention.
Figure 3:
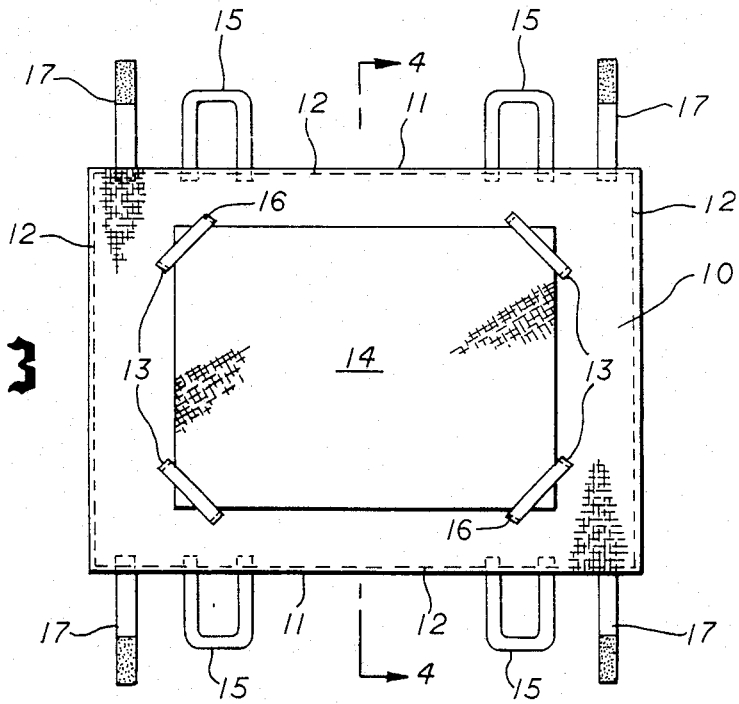
FIG. 3 is a plan view of one embodiment of the device in accordance with the invention.
Figure 4:
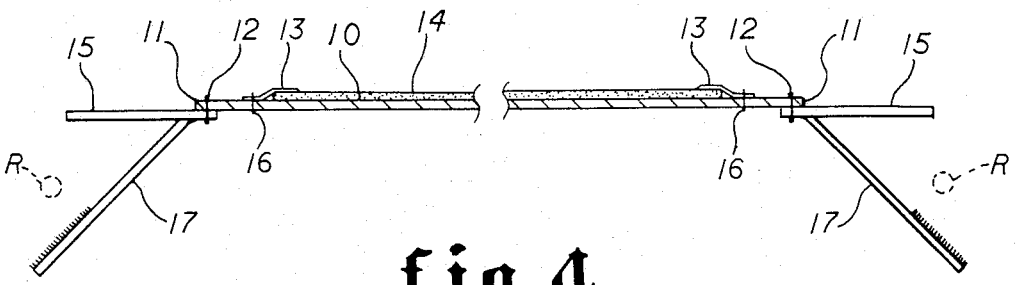
FIG. 4 is a transverse cross section view taken along line 4—4 of FIG. 3.

Referring to FIGS. 1 through 4, a preferred device for manipulating bedridden patients comprises a sheet 10 of porous fabric of a width and length to underlie a supine patient's torso from the shoulders to a location slightly below the buttocks. The lateral side edges 11 extend outward from the central portion and terminate near the longitudinal side edges of the bed mattress. The size of the sheet 10 may be varied to match the size of the patient and can, for example, be furnished in various sizes such as large, medium, small, child, and infant.

The sheet 10 is preferably a single, integral sheet of fabric material selected from any of a variety of sheet fabrics which have combined characteristics of adequate strength, reasonable porosity of breathability, fire and stain resistance, and washability.

The peripheral edges of the sheet 10 may be hemmed or stitched as indicated at 12 to prevent ravelling of the material. A set of straps 13 having each end affixed to the top surface of the sheet 10 by stitching 16 are disposed in a diagonally opposed pattern within the central portion to form a series of corner loops to receive the corners of an absorbent pad 14.

The corners of the absorbent pad 14 when inserted into the straps 13 retain the pad in proper relation on the sheet against the body movements of the patient. The pad 14 aids in the comfort of the patient P, prevents chafing of the skin, and alleviates potential problems arising from perspiration, incontinency or the like. A preferred pad is made of disposable absorbent material, however any suitable toweling or other cushioned absorbent material may be used. The pad 14 is easily released from the straps 13 on the fabric sheet 10 and may be disposed of after soiling, or laundered for reuse, depending upon the material used.

A pair of longitudinally spaced, generally U-shaped handles 15 are secured at each outer side edge 11 of the sheet 10 for manipulating the fabric sheet and the patient lying thereon. In a preferred embodiment the handles 15 are formed of fabric and secured by suitable means such as stitching 12 to the underside of the sheet 10. The handles 15 extend outwardly from the lateral side edges 11 of the fabric sheet 10 a distance sufficient for manipulation of the patient in the manner to be described.

A pair of tie straps 17 are secured at each lateral outer edge 11 of the sheet 10 spaced from the handles 15 near the corners of the sheet for releasably securing the fabric sheet 10 to the rails R of a hospital bed B in the manner to be described. The tie-straps 17 serve as a quick-connect/quick-disconnect securing means, which in the preferred embodiment comprises a strip of the fabric fastener material sold under the trademark "Velcro" which has the capability of strongly adhering to itself when plies of the material are pressed together. The tie-straps 17 are secured by suitable means such as stitching 12 to the underside of the sheet 10 and extend outwardly therefrom a distance sufficient for releasably fastening to the bed rails. The use of two tie-straps and two handles on each side provides the advantage, at least for some patients and their attendants, of permitting differential adjustment and the maintanence of the degree of roll of the upper and lower parts of the patient's torso.

It should be understood that other fastener means may be used without departing from the scope of the invention, such as securing a buckle at the end of a fabric strap, or simply providing a fabric strap or cord which may be tied to the bed rails.

Figure 5:
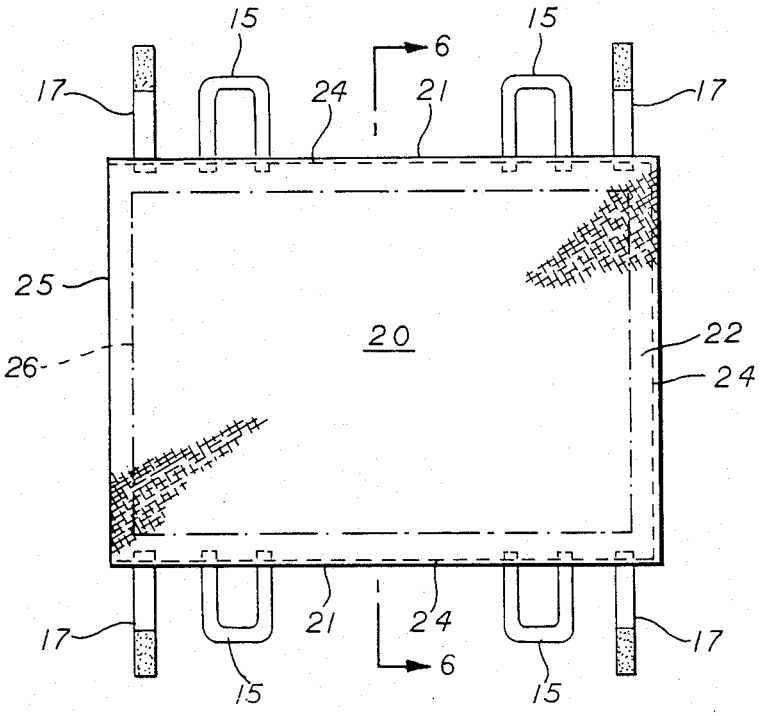
FIG. 5 is a plan view of another embodiment of the device for manipulating bedridden patients in accordance with the invention.
Figure 6:
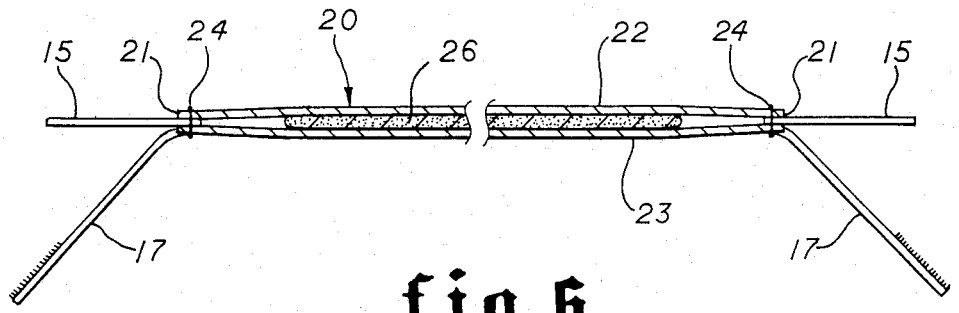
FIG. 6 is a transverse cross section view taken along line 6—6 of FIG. 5.

Referring now to FIGS. 5 and 6, a modified device for manipulating bedridden patients is shown. The same parts previously described have the same numerals of reference. The modified device comprises a double layered sheet 20 of porous fabric of a width and length to underlie a supine patient as previously described. The side edges 21 extend outward from the central portion and terminate near the sides of the bed mattress. The modified sheet 20 has an upper panel 22 and a lower panel 23 of substantially the same size. The panels 22 and 23 are constructed of a sheet of fabric material selected from any of a variety of sheet fabrics which have combined characteristics of adequate strength, reasonable porosity or breathability, fire and stain resistance, and washability.

The top and side peripheral edges of the panels 22 and 23 are sewn together (24) leaving the bottom edges 25 open such that the sheet 20 forms an envelope which removably receives an absorbent pad 26. The absorbent pad 26 when inserted into the envelope or sheet 20 is substantially retained in proper relation to the sheet irrespective of the body movements of the patient.

The pad 26 aids in the comfort of the patient, alleviates potential problems arising from perspiration, incontinency or the like, and the upper panel 22 prevents chafing of the skin. A preferred pad is made of disposable absorbent material, however any suitable toweling or other cushioned absorbent material may be used. The pad 26 is easily removed from the open bottom of the sheet 20 and may be disposed of after soiling, or laundered for reuse, depending upon the material used.

A pair of longitudinally spaced, generally U-shaped handles 15 are secured at each lateral outer edge 21 of the sheet 20 for manipulating the fabric sheet and the patient lying thereon. The preferred handles 15 are formed of fabric and secured between the upper and lower panels 22 and 23 by stitching 24 when the panels are sewn together. The handles 15 extend outwardly from the lateral side edges 21 of the fabric sheet 20 a distance sufficient for manipulation of the patient in the manner to be described.

A pair of tie straps 17 are secured at each outer edge 21 of the sheet 20 spaced longitudinally outward from the handles 15 near the corners of the sheet for releasably securing the fabric sheet 20 to the rails of the bed in the manner to be described. The tie-straps 17 serve as a quick-connect quick-disconnect securing means, which as described in the preferred embodiment, comprises a strip of "Velcro." Velcro is a registered trademark for hook and loop type quick release fasteners. The tie-straps 17 are also secured between the upper and lower panels 22 and 23 by stitching 24 when the side edges are sewn together and extend outwardly therefrom a distance sufficient for releasably fastening to the bed rails.

In use of the device of the invention, the fabric sheet 10 or 20 is placed on the patient's bed in a location (usually the center of the bed) where the patient would normally lie in a supine position, and at such elevation that the central portion extends from approximately the shoulders to just below the buttocks of the patient's torso, and with the two handles 15 and tie-straps 17 extending laterally outward toward the respective sides of the bed. This position of the device, with the patient in a supine position thereon, is illustrated in FIG. 1. The tie-straps 17 are fastened to the lower bed rails R on the respective sides to prevent the sheet 10 or 20 from shifting when the patient moves. In the supine position, the patient is perfectly comfortable and at ease and the device poses no obstacle to restful comfort.

When it is desired to roll the patient onto his or her side, for example the right side, the left hand tie-straps (as viewed by the patient) are unfastened and the left hand lateral side portion of the sheet handles are placed on top of the patient and the attendant positions herself at the right side of the bed. Grasping the handles and using the side of the bed for leverage, the attendant simply pulls the handles toward her, and the patient is automatically rolled onto his or her side.

The weight of the patient retains the sheet in the location in which it was placed on the bed, and the pulling on the handle very gently, conveniently and comfortably rolls the patient onto his or her side. When the patient is at the desired degree of roll, e.g., ¼, ½ or ¾ roll, the tie-straps are simply wrapped around the upper side rail of the bed and the "Velcro" is pressed together, thus the patient is effectively and comfortably held, in a hammock-like effect, in the desired position. The entire manipulation is extremely fast, easy and effective, and can readily be done by one person.

In a side position of rest, the patient's back is removed from its supine position on the bed, and the fabric sheet 10 or 20, being porous, permits ventilation or "breathing" of the patient's back whereby to prevent or aid in the cure of bed sores or to alleviate pressure on tender portions of the body. The patient when comfortably supported and manipulated from time to time in the proper manner has a reduced chance of having fluids accumulate in the lungs, thereby to preventing or to aiding in the treatment of pneumonia and other diseases that might arise from prolonged inactivity and/or confinement to a supine position. The device completely eliminates all of the discomfort, draw backs and labor intensiveness of the existing drawsheet or water absorbing pads and the practice of wedging pillows under the patient's back to obtain a desired comfortable position.

To return the patient to a supine position, it is only necessary to grasp one of the handles, release the tie-straps and gradually move the handle toward the left side of the bed, whereupon the patient rolls gently back into the supine position. To prop the patient up on his or her left side, it is only necessary to repeat the above described procedure using the right-hand handles and tie-straps. Manipulation of the bed-ridden patient is thus simplicity itself. Even an untrained person working with or assisting an extremely brittle or pain filled patient can gently and comforably roll the patient to position of greater restfulness.

The pad 14 or 26 aids in the comfort of the patient P, prevents chafing of the skin, and alleviates potential problems arising from perspiration, incontinency or the like. The pad is easily removed from the straps 13 on the fabric sheet 10, or from the open bottom 25 of the sheet 20 and may be disposed of after soiling, or laundered for reuse, depending upon the pad material used.

In addition, the two illustrated embodiments of the device are completely machine washable and may be formed of stain and fire resistant materials which are compatible with and satisfy the sanitation requirements of hospitals and other institutions.

While this invention has been described fully and completely with emphasis on two preferred embodiments, it should be understood that within the scope of the appended claims the invention may be practiced otherwise than as specifically described herein.

I claim:

1. A drawsheet adapted to be releasably secured to the railings of a hospital bed for manipulating a bedridden patient into various positions of rest and suitable for manipulation by a single attendant comprising;

a flexible, pliant sheet of porous fabric of a size to underlie the torso of a patient, an absorbent pad member removably received and carried by said sheet, said fabric sheet having a central portion of a width approximately equal to the width of the patient's torso and of a length to underlie the patient's torso from approximately the shoulders to the buttocks and side portions extending outward from said central portion, said sheet being flexible and unreinforced along its entire periphery and along its entire length, said sheet having means to removably receive and carry an absorbent pad in association therewith, releasable fastening means secured on each side of said sheet for removably securing said sheet to the adjacent lower bed railings in an extended position beneath the patient in the supine position, said releasable fastening means comprising a pair of elongated tie-straps secured to each outer side edge of said sheet in a longitudinally spaced relation and having free ends each provided with quick-connect/quick-disconnect securing means, said releasable fastening means on one side being releasable from the lower bed railings on one side of the bed to be refastened on the top bed railings on the other side of the bed where the fastener means remains fastened thereto for holding said sheet to the bed railing in partially encircling relation to the patient's torso in a selected position to insure uniform and comfortable engagement of said sheet and said pad with the patient's torso substantially the length of said sheet, and a pair of handles secured on each side of said sheet and extending outwardly therefrom adjacent respective sides of the bed for moving one side portion of said sheet into partially encircling relation to the torso of the patient and for rolling the patient from a supine position into a position on one of the patient's sides, said handles being spaced apart and positioned toward the opposite ends of said sheet and comprising a pair of generally U-shaped handles of fabric secured to each outer side edge of said sheet in a longitudinally spaced relation permitting differential adjustment of the degree of roll of the upper and lower parts of the patient's torso.

2. A drawsheet according to claim 1 in which said pad receiving means comprises a series of straps affixed to the top surface of said sheet in a diagonally opposed pattern within the central portion to form a series of loops to receive the corners of said absorbent pad for removably receiving and carrying the same.

3. A drawsheet according to claim 1 in which said fastening means comprises at least one strip of a fabric fastener material.

4. A drawsheet according to claim 1 in which said absorbent pad is of disposable material.

5. A drawsheet according to claim 1 in which said sheet comprises an upper panel and a lower panel of flexible, pliant porous fabric of substantially the same dimension having mating top and side peripheral edges sewn together and the bottom edges open to form an envelope for removably receiving and carrying said absorbent pad within the central portion.

6. A drawsheet adapted to be releasably secured to the railings of a hospital bed for manipulating a bedridden patient into various positions of rest and suitable for manipulation by a single attendant comprising;

a flexible, pliant sheet of porous fabric of a size to underlie the torso of a patient, means to removably receive and carry an absorbent pad member on said sheet, said fabric sheet having a central portion of a width approximately equal to the width of the patient's torso and of a length to underlie the patient's torso from approximately the shoulders to the buttocks and side portions extending outward from said central portion, said sheet being flexible and unreinforced along its entire periphery and along its entire length, releasable fastening means secured on each side of said sheet for removably securing said sheet to the adjacent lower bed railings in an extended position beneath the patient in the supine position, said releasable fastening means comprising a pair or elongated tie-straps secured to each outer side edge of said sheet in a longitudinally spaced relation and having free ends each provided with quick-connect/quick-disconnect secure means, said releasable fastening means on one side being releasable from the lower bed railings on one side of the bed to be refastened on the top bed railings on the other side of the bed where the fastener means remains fastened thereto for holding said sheet to the bed railing in partially encircling relation to the patient's torso in a selected position to insure uniform and comfortable engagement of said sheet and said pad with the patient's torso substantially the length of said sheet, and a pair of handles secured on each side of said sheet and extending outwardly therefrom adjacent respective sides of the bed for moving one side portion of said sheet into partially encircling relation to the torso of the patient and for rolling the patient from a supine position into a position on one of the patient's sides, said handles being spaced apart and positioned toward the opposite ends of said sheet and comprising a pair of generally U-shaped handles of fabric secured to each outer side edge of said sheet in a longitudinally spaced relation permitting differential adjustment of the degree of roll of the upper and lower parts of the patients' torso.

* * * * *